US008847493B2

(12) United States Patent
Dentinger

(10) Patent No.: US 8,847,493 B2
(45) Date of Patent: Sep. 30, 2014

(54) ELECTRICAL MODULE AND METHOD FOR ILLUMINATING A HIGH INTENSITY DISCHARGE (HID) LAMP ON A VEHICLE

(71) Applicant: Michael Dentinger, Yellowknife (CA)

(72) Inventor: Michael Dentinger, Yellowknife (CA)

( * ) Notice: Subject to any disclaimer, the term of this patent is extended or adjusted under 35 U.S.C. 154(b) by 24 days.

(21) Appl. No.: 13/631,163

(22) Filed: Sep. 28, 2012

(65) Prior Publication Data

US 2013/0082597 A1 Apr. 4, 2013

Related U.S. Application Data

(60) Provisional application No. 61/540,234, filed on Sep. 28, 2011.

(51) Int. Cl.
*B60Q 1/02* (2006.01)

(52) U.S. Cl.
USPC ..... 315/82; 315/326; 315/206

(58) Field of Classification Search
CPC ..... Y02B 20/16; Y02B 20/20; Y02B 20/202; H05B 39/02; H05B 39/04; F02P 3/0884
USPC ..... 315/77, 82, 200 R, 206, 208, 209 CD, 315/326, 352, DIG. 7
See application file for complete search history.

(56) References Cited

U.S. PATENT DOCUMENTS

| | | | | |
|---|---|---|---|---|
| 4,513,227 | A | 4/1985 | Labadini et al. | |
| 6,181,083 | B1 | 1/2001 | Moisin | |
| 6,580,220 | B1 * | 6/2003 | Yen | 315/82 |
| 2007/0007905 | A1 * | 1/2007 | Chu | 315/209 CD |
| 2008/0093995 | A1 * | 4/2008 | Song | 315/209 M |
| 2008/0179968 | A1 | 7/2008 | Szabados et al. | |
| 2008/0211425 | A1 * | 9/2008 | Wilhelm et al. | 315/278 |
| 2010/0327776 | A1 * | 12/2010 | Yufuku et al. | 315/307 |

* cited by examiner

*Primary Examiner* — Jason M Crawford
(74) *Attorney, Agent, or Firm* — Bennett Jones LLP

(57) ABSTRACT

The invention is directed to an electrical module and a method for illuminating a HID lamp on a vehicle, and in particular an off-road recreational vehicle. The electrical module and the method involve a capacitor and a voltage delay mechanism. The capacitor may be charged during the operation of the vehicle or when the operator wishes to illuminate the HID lamp. The voltage delay mechanism comprises a charge-actuated switch and a breakdown voltage means for preventing the supply of current to the HID lamp until the capacitor is charged to a voltage sufficient to illuminate the HID lamp. The voltage delay mechanism also comprises a power-actuated latch relay for maintaining the charge-actuated switch in a position that bypasses the breakdown voltage device, so that the HID lamp remains illuminated even after the voltage has decreased to the operating requirements of the HID lamp.

10 Claims, 8 Drawing Sheets

ELECTRICAL MODULE AND METHOD FOR ILLUMINATING A HIGH INTENSITY DISCHARGE (HID) LAMP ON A VEHICLE

FIELD OF THE INVENTION

The present invention is directed to an electrical module and method for illuminating a high-intensity discharge (HID) lamp on a vehicle, and in particular on an off-road recreational vehicle.

BACKGROUND TO THE INVENTION

HID lamps are a type of electrical gas-discharge lamp comprising a translucent housing containing a set of metal electrodes and filled with gas and metal salts. When an electrical current is passed through the lamp circuit, an electric arc forms between the electrodes which heats and vaporizes the metal salts to form plasma that increases the light intensity of the arc.

In off-road vehicles (including, for example, snowmobiles and all-terrain vehicles), HID lamps can be a desirable alternative to conventional lamps, such as incandescent tungsten-halogen lamps. HID lamps may provide greater light intensity, higher energy efficiency, more desirable color temperature, and greater longevity than conventional lamps. There are available a number of commercially available HID lamps for off-road recreational vehicles having sealed ballasts that can be installed in place of conventional lamps.

At the same time, however, HID lamps typically have different electrical power requirements than conventional lamps. HID lamps typically require a relatively higher voltage pulse during the start up phase, followed by a relatively lower voltage during use. For example, an HID lamp suitable for use in an off-road vehicle may require a direct current ("DC") of approximately 10 amperes ("amps") and a voltage of 12 volts during the start-up phase of operation, and a current of approximately 6 amps and a voltage of no less than 9 volts following the start-up phase. In addition, the DC power supply should be stable for optimal performance, constant luminescence, and longevity of HID lamps.

The electrical systems of many off-road vehicles designed for conventional lamps are not well suited for HID lamps. Many off-road recreational vehicles do not have a battery and the electrical systems are solely stator powered. Some off-road recreational vehicles do have a battery, but frequently the battery is connected to only the cranking and charging systems and not the ignition or headlamp system. In either case, the ability of the off-road recreational vehicle to deliver the voltage pulse required to start up the HID lamp is very limited, especially if they are started simultaneously with the vehicle. One prior art solution involves directly wiring the battery (if there is one) to the HID lamps. This configuration may be sufficient to meet the start-up phase power requirements, but prolonged use of the HID lamp will rapidly drain the battery because the battery is intended to be wired only to the cranking and charging systems, and the charging system output is just enough to charge the battery. Also, a number of off-road recreational vehicles deliver alternating current ("AC") to the head lamps. Although a rectifier can be used to convert DC power to AC power, such conversion may result in elevated voltage spikes and current instability, both of which can damage HID lamps.

A number of different ideas have been proposed to facilitate the use of HID lamps on off-road recreational vehicles. However, the known proposals, including directly wiring the battery to the HID lamps, work poorly, not at all, or compromise functionality. Accordingly, there is a need in the art for an apparatus, and a method for using HID lamps on recreational vehicles. Such method and apparatus would preferably ensure sufficient power supply upon start-up, mitigate the problem of rapid battery drain, and would facilitate a sufficient and steady flow of DC power to the HID lamps. It would also be beneficial if the apparatus were relatively simple for the end-user to install and use.

SUMMARY OF THE INVENTION

In one aspect, the present invention provides an electrical module for illuminating a HID lamp on a vehicle having a power source connected to a HID switch. The electrical module comprises an input, an output, a capacitor, and a voltage delay mechanism comprising a charge-actuated switch, a breakdown voltage device, and a power-actuated latch relay. The input is operatively connected to the power source through the HID switch. The output is operatively connected to the HID lamp. The capacitor is operatively connected to the input for charging by the power source. The voltage delay mechanism is operatively connected to the capacitor. The charge-actuated switch is operatively connected to the capacitor, and has an HID-inactive position and an HID-active position in which the power source is connected to the output. The breakdown voltage device is operatively connected to the capacitor and to the charge-actuated switch, to prevent the charge-actuated switch from moving to the HID-active position, unless the capacitor is charged to a voltage sufficient to start up the HID lamp. The power-actuated latch relay is operatively connected to the charge-actuated switch, the latch relay operating to maintain the charge-actuated switch in its HID-active position by bypassing the breakdown voltage device.

In one embodiment, the electrical module described above further comprises a charge input for separately charging the capacitor, which may be connected to the capacitor by the charge-actuated switch in its HID-inactive position.

In one embodiment of the electrical module first described above, the power-actuated latch relay comprises a connection to the output.

In one embodiment of the electrical module first described above, the breakdown voltage device comprises a diode, which may be a Zener diode.

In one embodiment, the electrical module first described above further comprises at least one rectifier operatively connectable between the power supply and the capacitor, and may further comprise at least one voltage regulator operatively connectable to regulate the voltage of the DC power supplied to the HID lamp.

In another aspect, the present invention provides a method of illuminating a HID lamp on a vehicle. The method comprises the steps of:

(a) connecting the HID lamp to an electrical module having a capacitor and a voltage delay mechanism;

(b) charging the capacitor during operation of the vehicle; and (c) using the voltage delay mechanism to prevent the supply of current to the HID lamp until the capacitor is charged to a voltage sufficient to start up the HID lamp.

In one embodiment of the method described above, the electrical module comprises a latch relay, and the method further comprises the step of using the latch relay to maintain supply of current to the HID lamp after the capacitor has discharged.

In one embodiment of the method first described above, the method further comprises the step of rectifying the current from AC to DC prior to supplying the current to the capacitor and/or the HID lamp.

In one embodiment of the method first described above, the vehicle is an off-road recreational vehicle.

In another aspect, the invention provides a kit for modifying or retro-fitting a vehicle to illuminate an HID lamp. The kit comprises an electrical module as first described above, and an adapter comprising electrical connections between the electrical module input and a vehicle light switch.

In one embodiment of the kit described above, the adapter creates a connection between the electrical module input and a vehicle high beam switch.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

Figure 1:
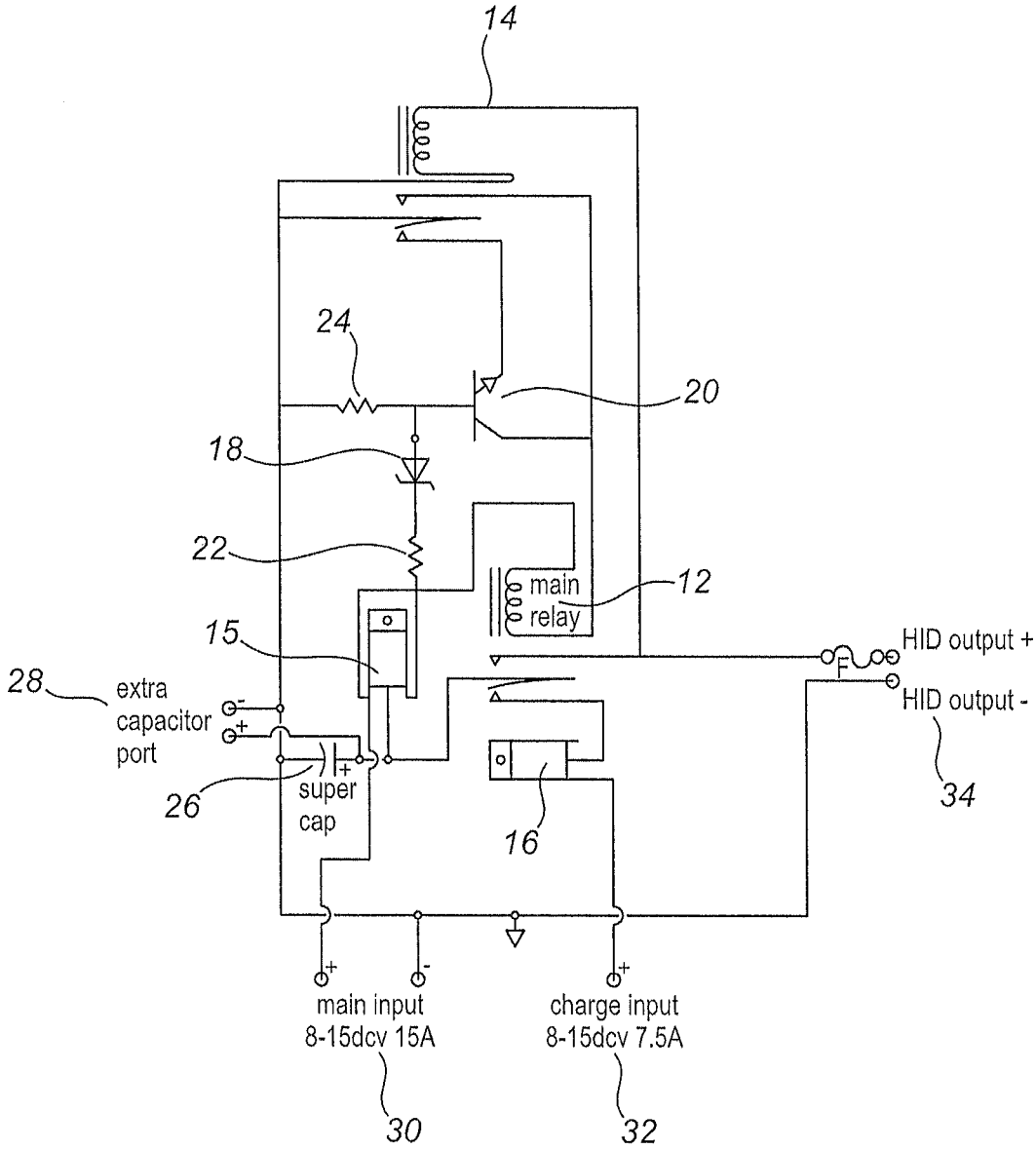
FIG. 1 depicts a circuit diagram for one embodiment of a DC module of the present invention.

The invention relates to an electrical module and method for illuminating high-intensity discharge (HID) lamps on a vehicle. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

It will be understood that the electrical module of the present invention may be suitably adapted to illuminate an HID lamp on any type of vehicle, including an off-road recreational vehicle. As used herein, the term "off-road recreational vehicle" refers to any motorized mode of transportation built for cross-country travel on land, water, sand, snow, ice or marsh or swamp land or on natural terrain and, without limiting the generality of the foregoing, includes 4-wheel drive vehicles, low pressure tire vehicles, motor cycles and related 2-wheel vehicles, amphibious machines, all terrain vehicles, miniature motor vehicles, snowmobiles, snow vehicles, minibikes, motorboats, and tracked vehicles.

It will be understood that the vehicle has a power source for supplying power to the HID lamp. The power source may be any suitable source of electrical current such as a battery, a stator, or a combination thereof; thus, the module of the present invention may be used on a vehicle that is equipped with or without a battery. If necessary, the electrical system may further comprise a rectifier to convert an AC power source to a DC power source.

It will be understood that the electrical module of the present invention is installed in an electrical circuit connecting the power source via a HID switch to the HID lamp. The HID switch is used to control the supply of power to the electrical module and the HID lamp. The electrical module has an input operatively connected to the power source, and an output operatively connected to the HID lamp. In one embodiment, the electrical module also has a charge input (as will be further described below) that is connected to the power source.

It will be understood that the electrical module of the present invention may be practiced in several modes, of which non-limiting examples are provided below.

In one example, the electrical module may be installed on a vehicle having no existing lamp and to which a HID lamp is being added. New circuitry and a HID switch may be added to connect the input to the power source, and if the charge input is provided, to connect the charge input to the power source.

In another example, the electrical module may be installed on a vehicle to replace an existing switched lamp. The circuitry and switch for the existing lamp may be adapted to connect the input to the power source. If the charge input is provided, new circuitry may be added to connect the charge input to the power source.

In another example, the electrical module may be installed on a vehicle to supplement an existing lamp (such as a low beam lamp). New electrical circuitry and a HID switch may be added to connect the input to the power source. If the charge input is provided, the circuitry for the existing lamp (such as the low beam lamp circuitry) or other circuitry may be used to connect the charge input to the power source.

In another example, the electrical module may be installed on a vehicle to replace an existing first switched lamp (such as high beam lamp) while supplementing an existing second lamp (such as a low beam lamp). The circuitry and switch for the existing first lamp (such as the high beam lamp circuitry and switch) may be used to connect the input to the power source. If the charge input is provided, the circuitry for the existing second lamp (such as the low beam lamp circuitry) or other circuitry may be used to connect the charge input to the power source.

In general, the electrical module of the present invention comprises an input, an output, capacitor, and a voltage delay mechanism. The input is operatively connected to the HID switch. The output is operatively connected to the HID lamp. The capacitor is operatively connected to the input for charging by the power source. The voltage delay mechanism comprises a charge-activated switch, a breakdown voltage device, and a power-actuated latch relay.

The charge-actuated switch is operatively connected to receive current from the capacitor. As used herein, the "charge-activated switch" refers to any electrical component or combination of electrical components known in the art that is actuated by electricity from a HID-inactive position to an HID-active position in which the power source is connected to the output.

The breakdown voltage device is operatively connected to the capacitor and to the charge-actuated switch to prevent the charge-actuated switch from moving to the HID-active position unless the capacitor is charged to a voltage sufficient to start up the HID lamp. As used herein, the "breakdown voltage device" refers to any electrical component or combination of electrical components known in the art that provides substantial resistance to electric current flow at voltages below a certain level known as the breakdown voltage.

The power-actuated latch relay is operatively connected to the charge-actuated switch. As used herein, the "power-actuated latch relay" refers to any electrical component or combination of electrical components known in the art that is actuated by electricity to maintain the charge-actuated switch in its HID-active position by bypassing the breakdown voltage device. With this combination of components, the electric module ensures that the HID lamp does not load the power source of the vehicle until a sufficient voltage pulse is available to illuminate the HID lamp, but continues to illuminate the HID lamp even after the voltage has decreased to the operating range of the HID lamp.

FIG. 1 shows a circuit diagram for one embodiment of a DC module (10) for use on a vehicle having a DC electrical system. The DC module (10) comprises the following components: a main relay (12), a latch relay (14), a first diode (15), a second diode (16), a Zener diode (18), a transistor (20), a limiting resistor (22), a bleed resistor (24), a capacitor (26), an additional capacitor port (28), an input (30), a charge input (32), and output (34). In this embodiment, the charge-actuated switch comprises the main relay (12) and the transistor (20). The breakdown voltage device is implemented by the Zener diode (18) in reverse bias, limiting resistor (22), and the bleed resistor (24). The power-actuated latch relay comprises the latch relay (14) and the transistor (20). The additional capacitor port (28) is provided for an optional additional capacitor (not shown) to accommodate greater loads on the system if required. All of the aforementioned components may comprise any suitable commercially available components as may be recognized by one skilled in the art. In particular, the capacitor (26) may comprise a capacitor, ultra capacitor, or capacitor bank as may be utilized by one skilled in the art.

The use and operation of the DC module (10) to illuminate a HID lamp is now described. The module (10) is connected to the HID-switch via the input (30), and to the HID lamp via the output (34). The module (10) may optionally be connected to the power source via the charge input (32) so that the power source charges the capacitor (26) via the charge input (32), the second diode (16), the main relay (12) in its inactive position (as shown in FIG. 1). When the operator of the vehicle wishes to illuminate the HID lamp, the operator turns on the HID switch to supply power to the input (30). The power source then charges the capacitor (26) via the input (30), the first diode (15) and the voltage delay mechanism. The first diode (15) also charges the charge capacitor (26) and the main relay (12), but does not actuate the main relay (12) from the HID-inactive position to the HID-active position. When the capacitor (12) is charged to a voltage exceeding the breakdown voltage of the Zener diode (18), the current flows to the transistor (20). The transistor (20) switches the main relay (12) from its HID-inactive position to its HID-active position. The main relay (12) in its HID-active position isolates the capacitor (26) from the charge input (32), and connects the power source to the output (34) to illuminate the HID lamp connected thereto. When the main relay (12) is in its HID-active position, latch relay (14) is activated to provide an alternate ground for the main relay (12), thereby maintaining the main relay (12) in its HID-active position by bypassing the Zener diode (18). This allows the power source to continue to supply current to the output (34) to maintain the HID lamp illuminated, even though the capacitor (26) has dissipated its charge and the voltage in the module (10) has decreased to the lower operational requirements of the HID lamp.

From the foregoing, one skilled in the art will understand that the DC module (10) prevents draining the power source by having the capacitor (26) store the charge from the power source, and preventing that charge from being supplied to the HID lamp until its voltage is sufficient to illuminate the HID lamp from its non-illuminated state and the HID switch is turned on. In particular, the charge input may continuously charge the capacitor (26) any time that the power source of the recreational vehicle is operating if the charge input (32) is connected to the power source, for example, via a low beam lamp circuit that is switched on whenever the vehicle is operating. Further, one skilled in the art will understand that if the capacitor (26) is pre-charged by the charge input (32) to a sufficient voltage to overcome the Zener diode (18), there will be virtually no delay in illumination of the HID lamp when the operator switches on the HID switch. However, it is not necessary to pre-charge the capacitor (26) in this manner because the capacitor (26) will in any event be charged when the operator switches on the HID switch to supply power to the input (30).

Figure 2:
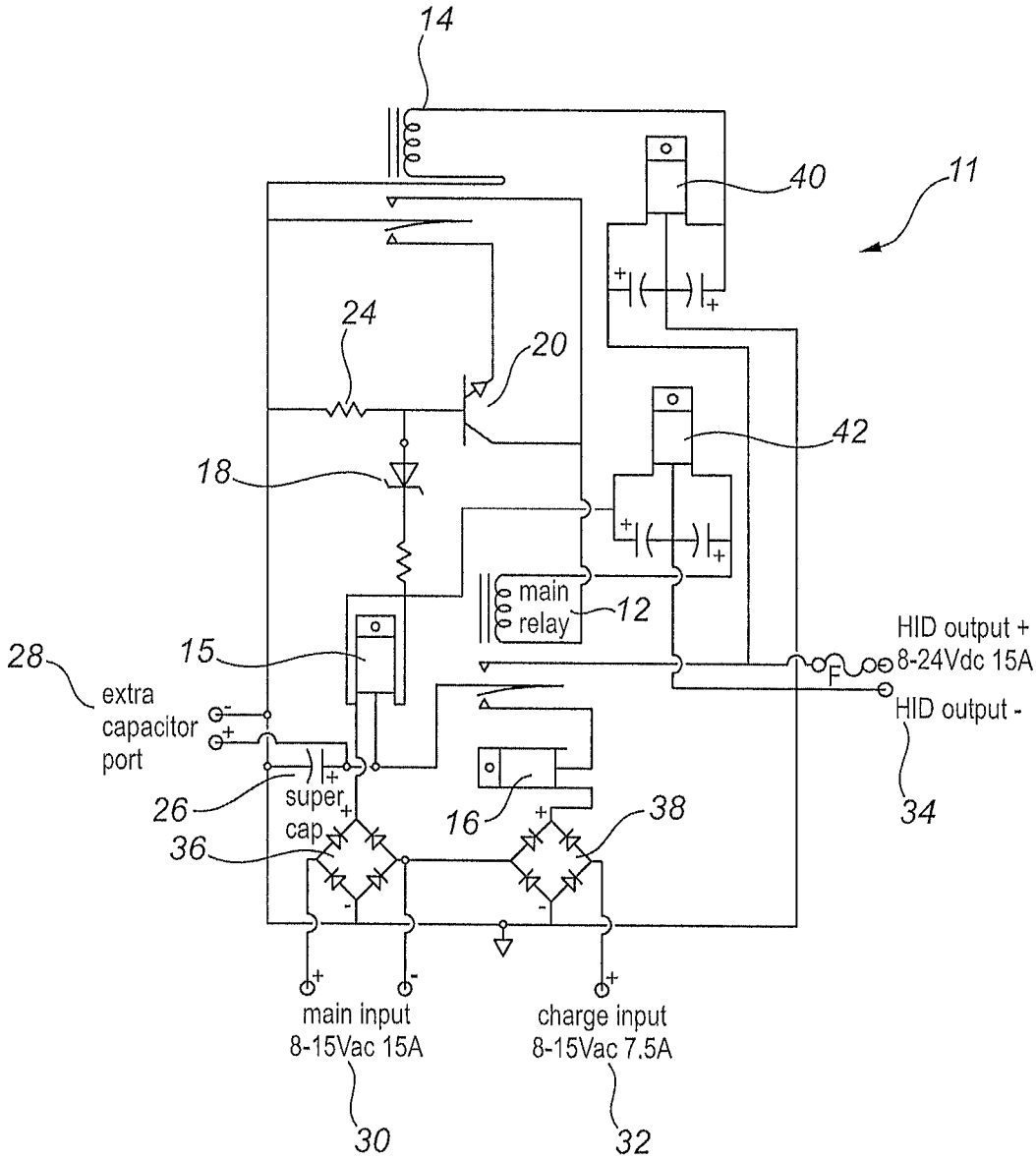
FIG. 2 depicts a circuit diagram for one embodiment of an AC module of the present invention.

FIG. 2 shows a circuit diagram for one embodiment of an AC module (11) for use on a vehicle having an AC electrical system. The AC module (11) has the following same components as the DC module (10): a main relay (12), a latch relay (14), a first diode (15), a second diode (16), a Zener diode (18), a transistor (20), a limiting resistor (22), a bleed resistor (24), a capacitor (26), an additional capacitor port (28), a input (30), a charge input (32), and output (34). In addition to these components, the AC module (11) further comprises a first rectifier (36), a second rectifier (38), a first voltage regulator (40), and a second voltage regulator (42).

The use and operation of the AC module (11) to illuminate a HID lamp is now described. The first rectifier (36) rectifies AC power to DC power at the input (30). The second rectifier (38) rectifies AC power to DC power at the charge input (32). The first voltage regulator (40) and the second voltage regulator (42) limit the voltage supplied to the latch relay (14), and the main relay (12), respectively, to mitigate the problems of voltage spike and fluctuation following rectification of AC to DC. In all other respects, the use and operation of the AC module (11) is analogous to the use and operation of the DC module (10) as described above. One skilled in the art will understand that rectification of AC power to DC power and voltage regulation may be achieved in a number of different ways, and the embodiment shown in FIG. 2 is not intended to be limiting to any one means of rectification and voltage regulation.

The electric modules as aforementioned may be adapted for use on an off-road recreational vehicle. By way of specific non-limiting examples, the AC module (11) may be used to illuminate an HID lamp with a permissible input voltage range of 9 to 32 volts, requiring DC power of approximately 10 amperes and a voltage of 12 volts during the start-up phase of operation, and a current of approximately 6 amps and a voltage of no less than 9 volts following the start-up phase. With such requirements, 12-volt relays are used for the main relay (12) and the latch relay (14) due to their ability to operate in a range of 8-14 volts. The breakdown voltage of the Zener diode (18) may be selected for the desired effect. If instead the HID lamp has a permissible input range of 9 to 16 volts, voltage regulators may be installed in the AC module (11) immediately after the first rectifier (36) and the second rectifier (38) so as to regulate the voltage within the rest of the AC module (11) and not simply in the relays (12, 14). In one embodiment, the DC module (10) and the AC module (11) are custom designed to be used with the factory wiring of off-road recreational vehicles and HID lamps. For example, the installation of the DC module (10) and the AC module (11) may be facilitated by plug connections at the input (30), the charge input (32) and the output (34) that fit the wiring harnesses provided at the low-beam circuit, the high-beam circuit, and the HID lamp, respectively. The electrical components may be selected by a person skilled in the art to achieve the desired effect within the parameters of the power source and the power requirements of the HID lamp provided on an off-road recreational vehicle. Further adaptations of the electrical module for use on an off-road recreational vehicle may include providing electrical components and connections that are resistant to water, extreme temperatures, and vibrations as may be encountered by an off-road recreational vehicle.

Figure 3:
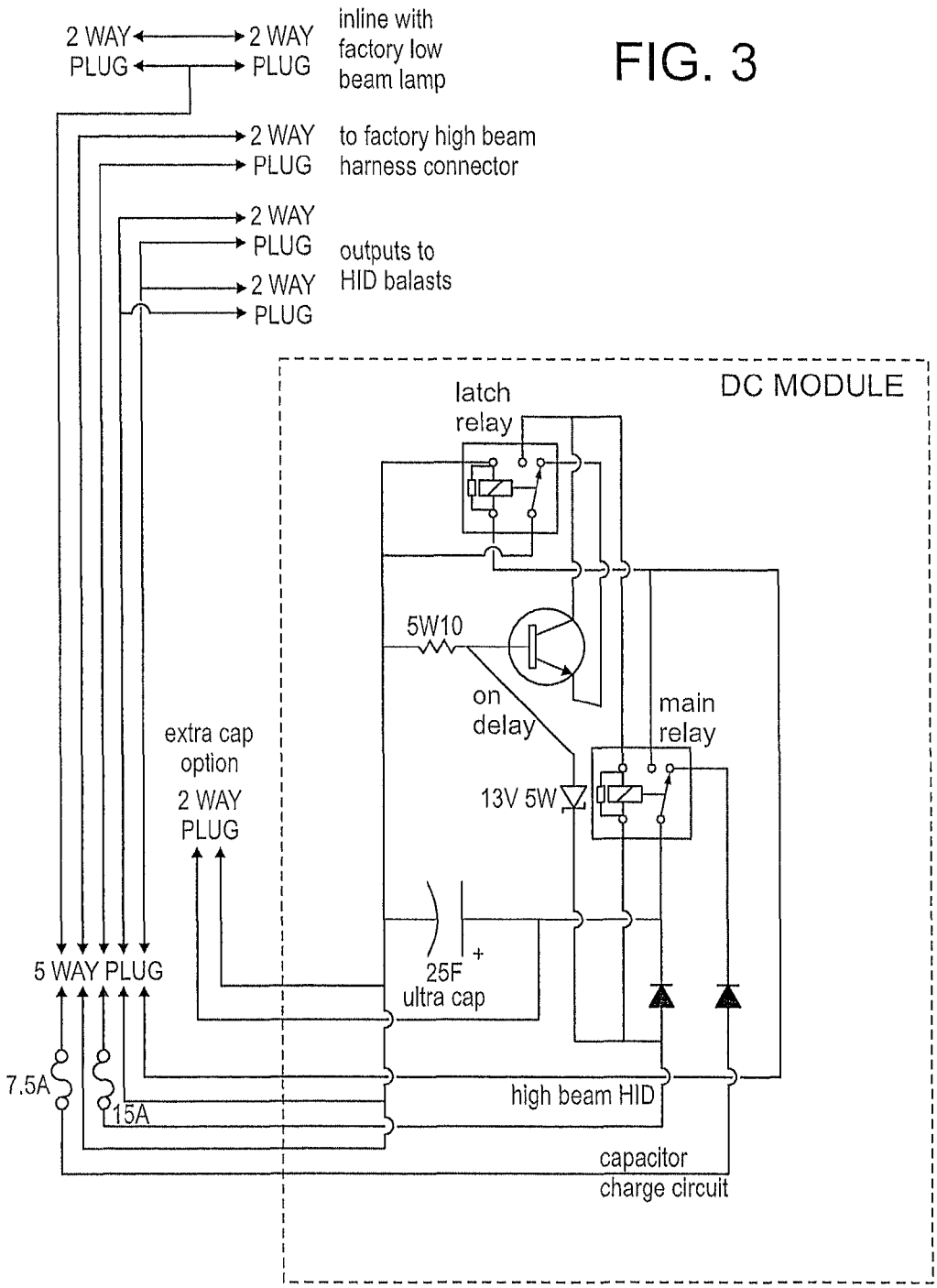
FIG. 3 depicts a circuit diagram for one embodiment of a DC module of the present invention.

FIG. 3 shows a circuit diagram of an embodiment of the DC module (10) implemented as a kit for plug-in installation to the factory wiring of the DC electrical system of the off-road recreational vehicle.

Figure 4:
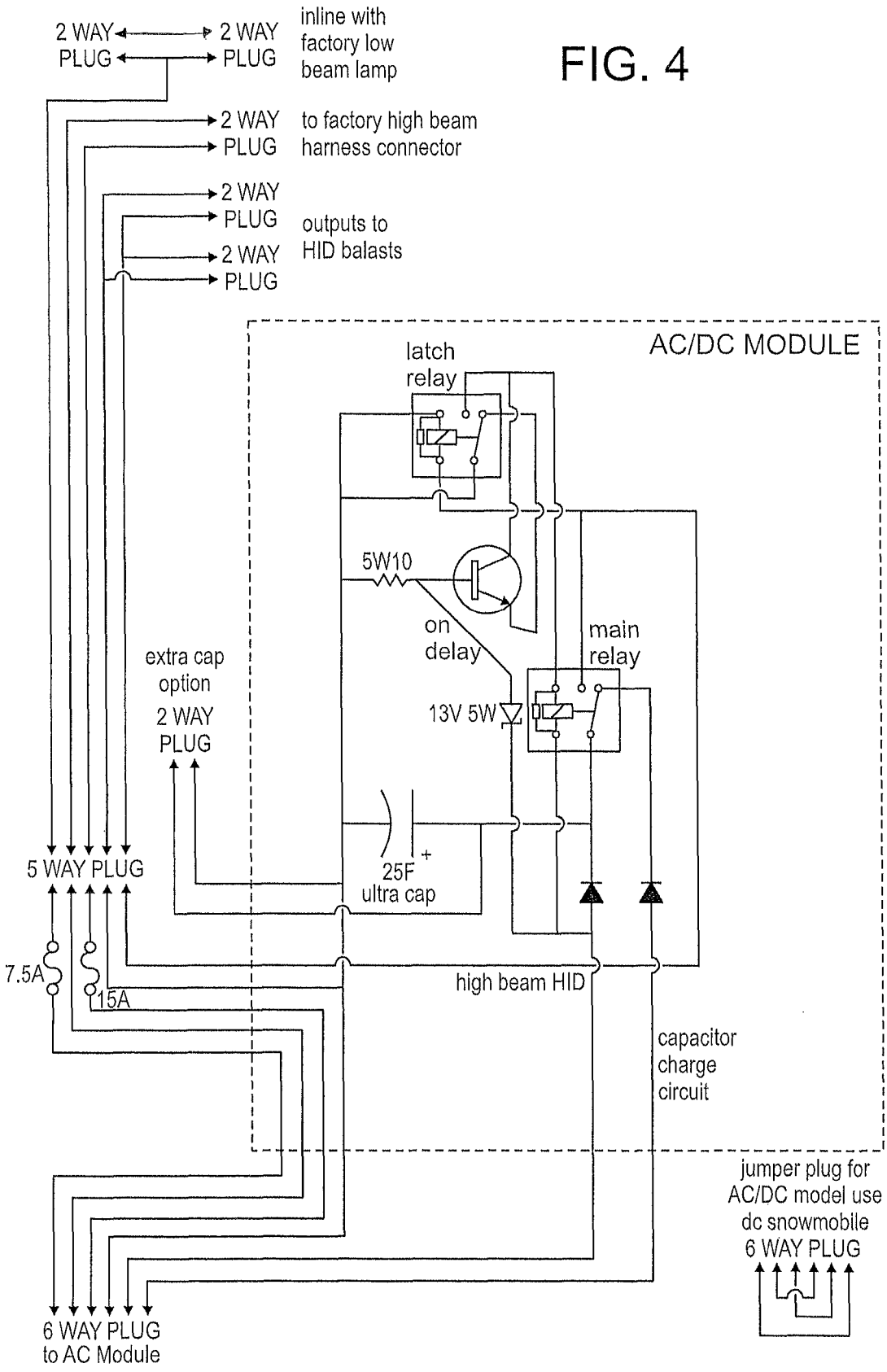
FIG. 4 depicts a circuit diagram for one embodiment of an AC/DC module of the present invention.
Figure 5:
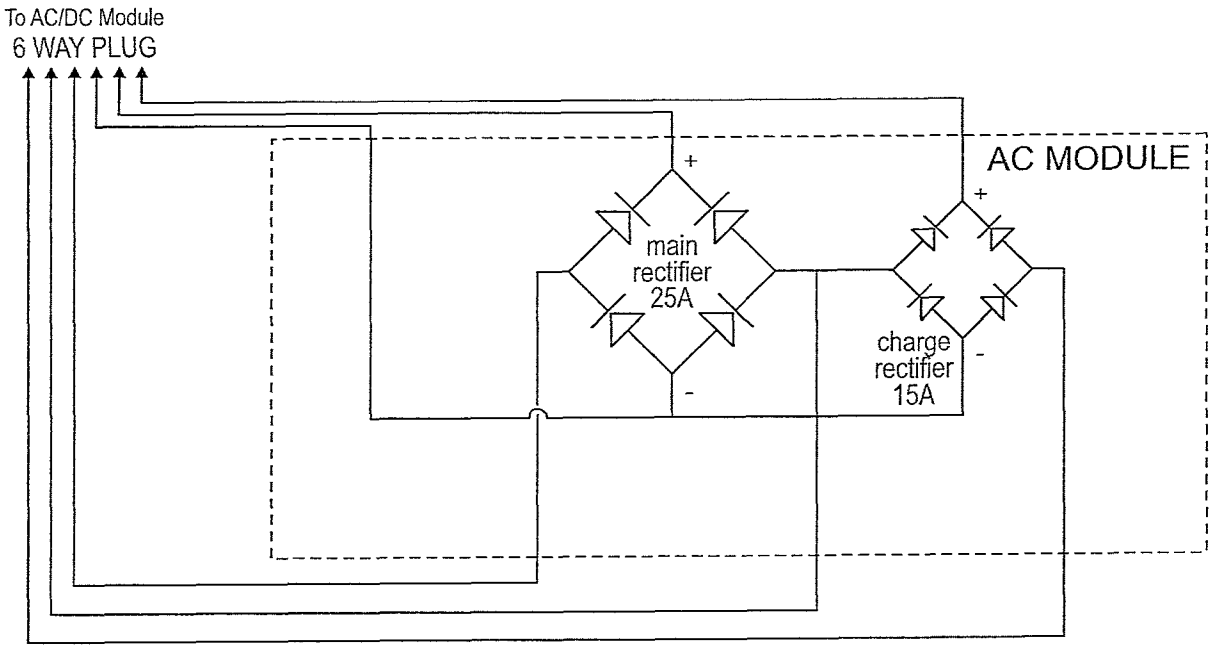
FIG. 5 depicts a circuit diagram for one embodiment of an AC module of the present invention.
Figure 6:
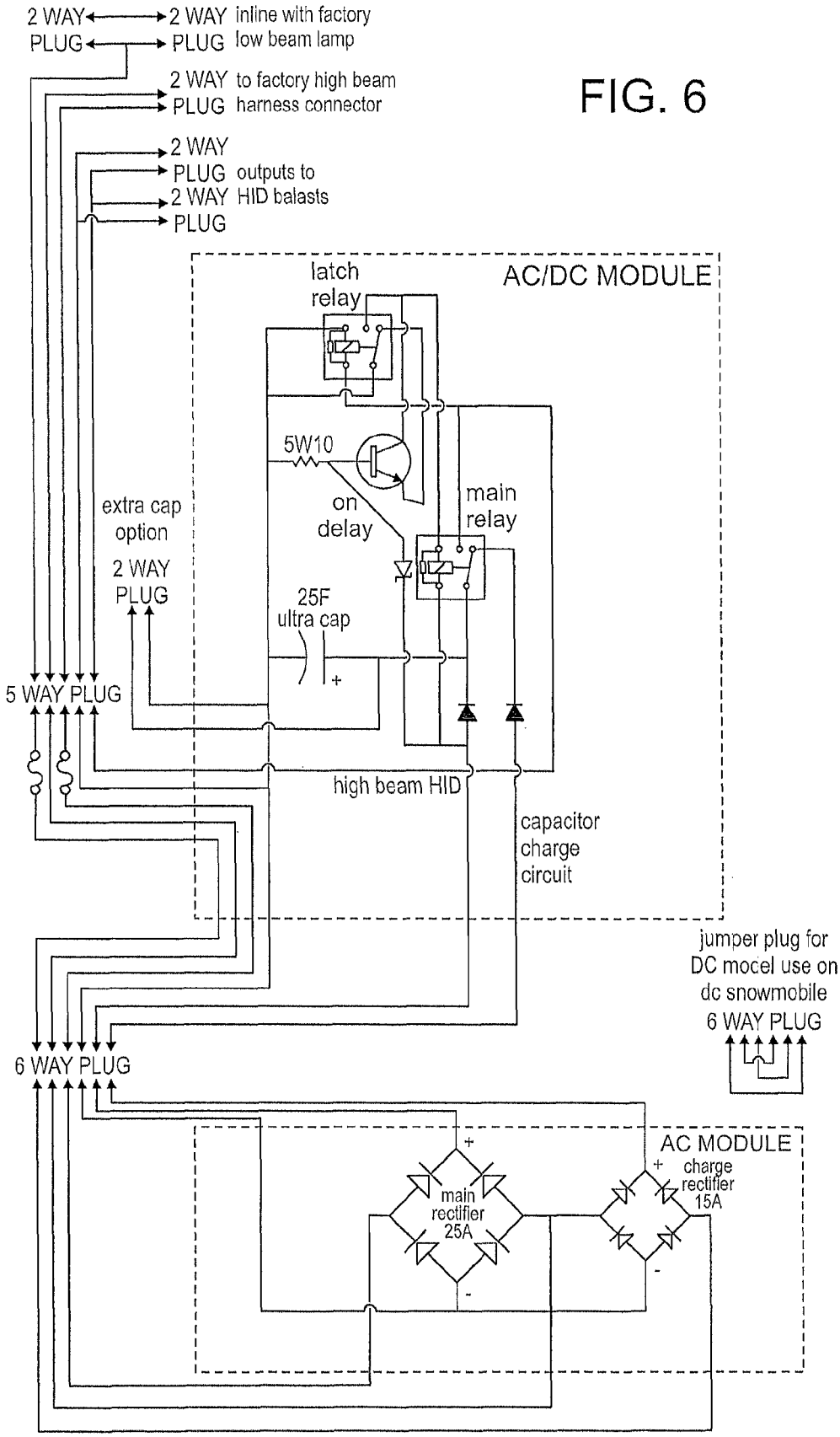
FIG. 6 depicts a circuit diagram for one embodiment of an AC module of the present invention connected to an AC/DC module of the present invention.

FIG. 4 shows a circuit diagram of an embodiment of the AC/DC module (10) that may be combined with the AC rectifier module shown in FIG. 5 and an intervening voltage regulator to create a combined module shown in FIG. 6. The combined module of FIG. 6 may be implemented as a kit for plug-in installation to the factory wiring of the AC electrical system of an off-road recreational vehicle.

Figure 7:
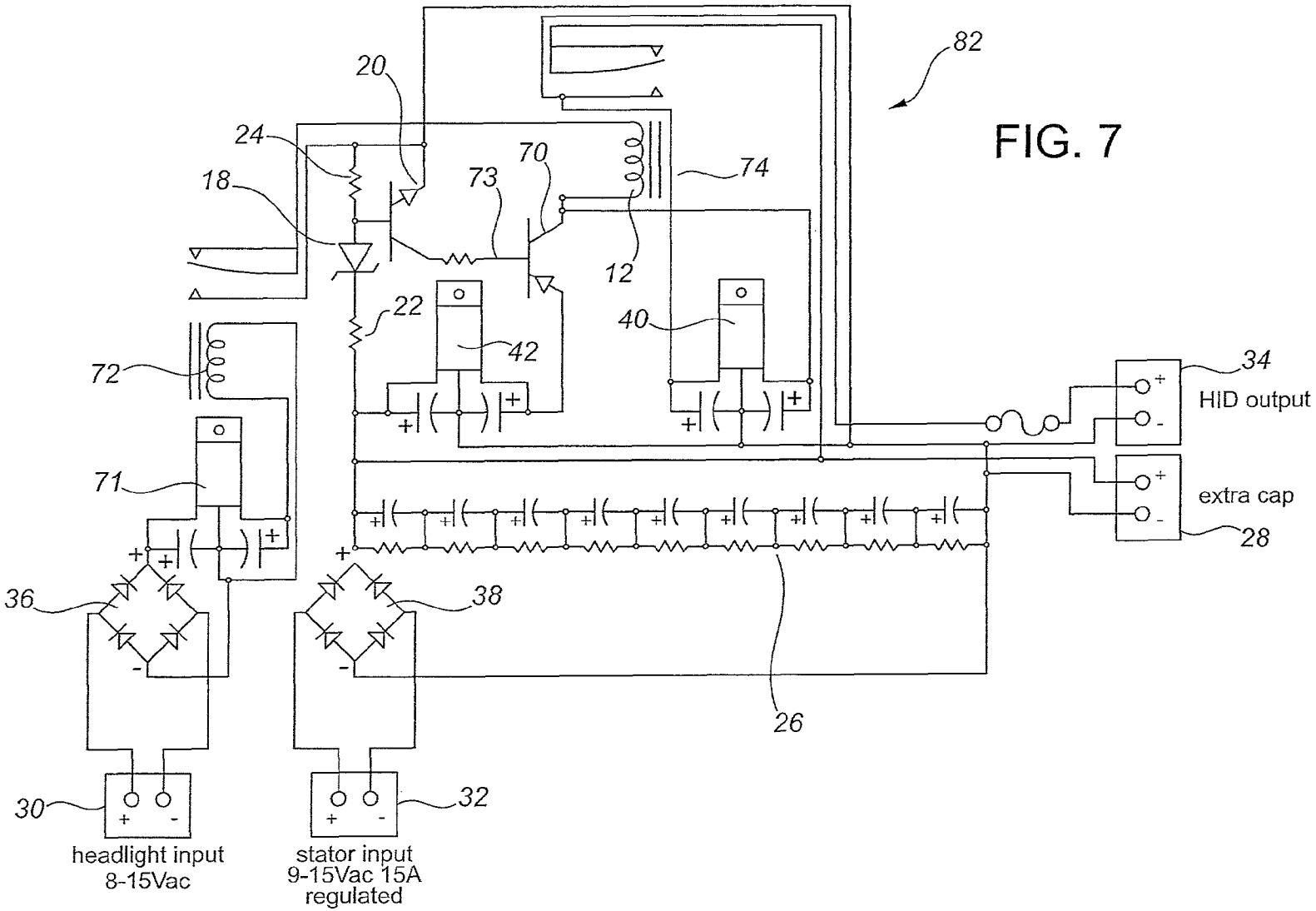
FIG. 7 depicts a circuit diagram for one embodiment of an AC module of the present invention.

FIG. 7 shows one embodiment of an AC module (82) for use with a vehicle having AC powered headlamps. The AC module (82) has the following same components as the AC module (11): a main relay (12), a Zener diode (18), a transistor (20), a limiting resistor (22), a bleed resistor (24), a capacitor (26) (shown as a capacitor bank), an additional capacitor port (28), an input (30), a charge input (32), an output (34), a first rectifier (36), a second rectifier (38), a first voltage regulator (40), and a second voltage regulator (42). In addition to these components, the AC module (82) further comprises a transistor (70), a regulator (71), a switch relay (72), a limiting resistor (73), and a latch circuit (74). The charge input (32) supplies AC power from the power source to the second rectifier (38), which in turn supplies rectified DC power to charge the capacitor (26) whenever the charge input is energized, which may be whenever the vehicle is running. The input (30) supplies AC power from the power source to the first rectifier (36), which in turn supplies rectified DC power, as regulated by the regulator (71), to the switch relay (72). The switch relay (72) provides a ground to the main relay (12) to turn the system on and off with the switching of the HID switch. The actuation of the main relay (12) is delayed the same manner as the DC module (10) and AC module (11). The main relay circuit comprises current limiting resistor (73), transistor (70), latch circuit (74), and regulator (40), thereby controlling the main relay (12) with voltage rather than ground. When transistor (20) turns on, it turns on transistor (70) thereby applying voltage to the main relay (12) actuating the HID lamp. When the main relay (12) turns on, it also latches itself by applying voltage to latch circuit (74) through voltage regulator (40) until such a time that the input (30) is no longer energized.

Figure 8:
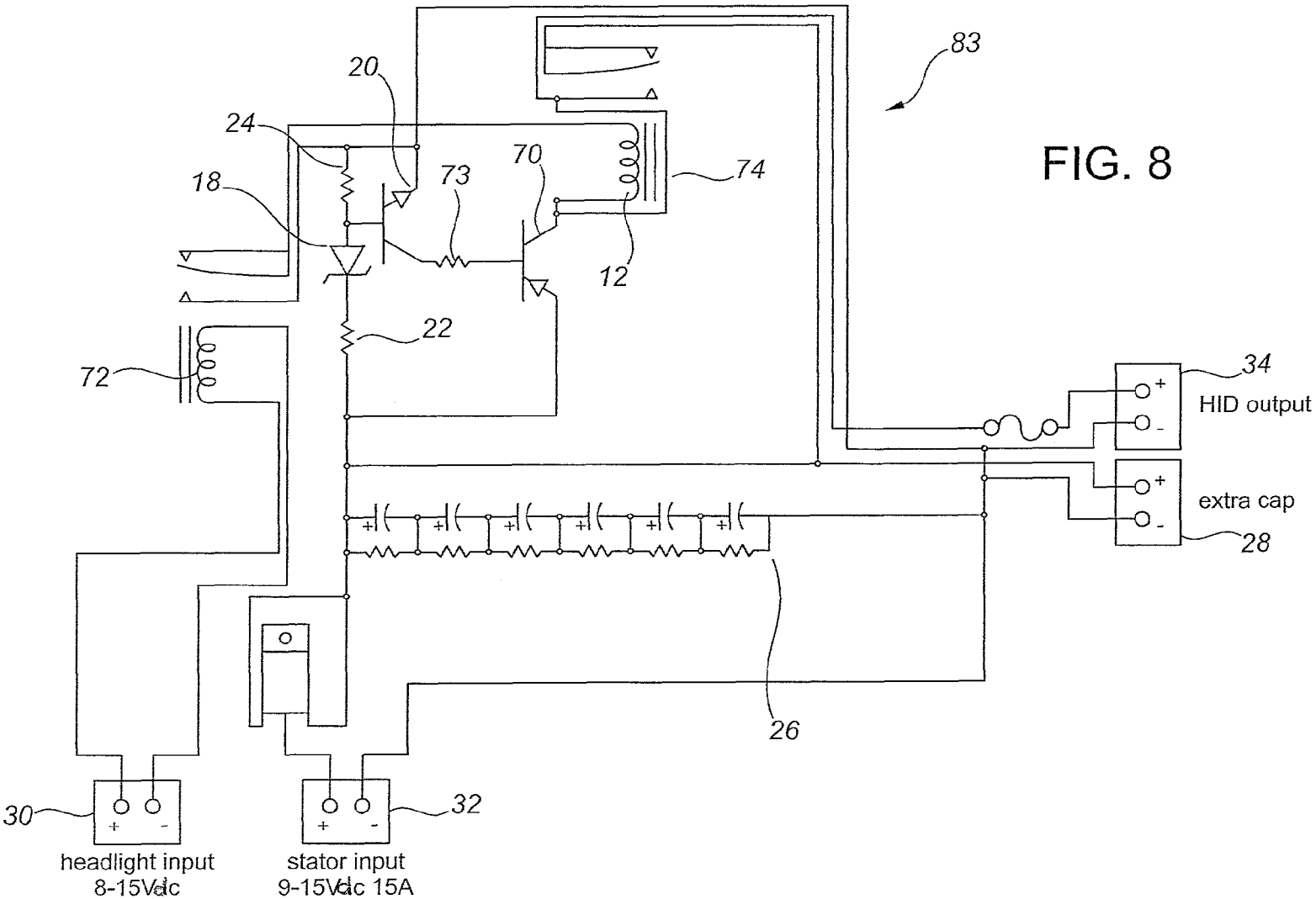
FIG. 8 depicts a circuit diagram for one embodiment of a DC module of the present invention.

FIG. 8 shows one embodiment of a DC module (83) for use with a vehicle having DC powered headlamps. The DC module (83) has the following same components as the DC module (10): a main relay (12), a Zener diode (18), a transistor (20), a limiting resistor (22), a bleed resistor (24), a capacitor (26) (shown as a capacitor bank), an additional capacitor port (28), an input (30), a charge input (32), and an output (34). In addition to these components, the DC module (83) further comprises a transistor (70), a switch relay (72), a limiting resistor (73), and a latch relay circuit (74). The charge input (32) supplies DC power from the power source to the capacitor (26) whenever the charge circuit is energized, which may be whenever the vehicle is running. The input (30) supplies DC power to the switch relay (72). In turn, the switch relay (72) supplies a ground to the coil of the main relay (12) to turn the system on and off with the actuation of the HID switch. The actuation of the main relay (12) is delayed the same manner as DC module (10). The main relay circuit comprises a current limiting resistor (73), transistor (70) and latch circuit (74) thereby controlling the main relay (12) with voltage rather than ground. When transistor (20) turns on, it turns on transistor (70) thus applying voltage to the main relay (12) actuating the HID lamp. When the main relay (12) turns on, it also latches itself by applying voltage to circuit (74) until such a time that the input (30) is no longer energized.

One skilled in the art will appreciate that one or more than one electrical module of the present invention may be employed on a vehicle to facilitate the use of more than one HID lamp.

As will be apparent to those skilled in the art, various modifications, adaptations and variations of the foregoing specific disclosure can be made without departing from the scope of the invention claimed herein.

What is claimed is:

1. An electrical module for illuminating an HID lamp on a vehicle having a power source connected to a HID switch, the electrical module comprising:

(a) an input operatively connected to the HID switch and an output operatively connected to the HID lamp;

(b) a capacitor operatively connected to the input for charging by the power source;

(c) a voltage delay mechanism operatively connected to the capacitor and comprising:

(i) a charge-actuated switch operatively connected to receive a charge from the capacitor, the charge-actuated switch having an HID-inactive position and an HID-active position in which the power source is connected to the output;

(ii) a breakdown voltage device operatively connected to the capacitor and to the charge-actuated switch, to prevent the charge-actuated switch from moving to the HID-active position, unless the capacitor is charged to a voltage sufficient to start up the HID lamp; and (iii) a power-actuated latch relay operatively connected to the charge-actuated switch, the latch relay operating to maintain the charge-actuated switch in its HID-active position by bypassing the breakdown voltage device.

2. The electrical module of claim 1 further comprising a charge input for separately charging the capacitor.

3. The electrical module of claim 2 wherein the charge input is connected to the capacitor by the charge-actuated switch in its HID-inactive position.

4. The electrical module of claim 1 wherein the power-actuated latch relay comprises a connection to the output.

5. The electrical module of claim 1 wherein the breakdown voltage device comprises a diode.

6. The electrical module of claim 5 wherein the diode is a Zener diode.

7. The electrical module of claim 1 further comprising at least one rectifier operatively connectable between the power supply and the capacitor.

8. The electrical module of claim 7 further comprising at least one voltage regulator operatively connectable to regulate the voltage of the DC power supplied to the HID lamp.

9. A kit for modifying or retro-fitting a vehicle to illuminate an HID lamp, the kit comprising:

(a) the electrical module of claim 1; and (b) an adapter comprising electrical connections between the electrical module input and a vehicle light switch.

10. The kit of claim 9 wherein the adapter creates a connection between the electrical module input and a vehicle high beam switch.

* * * * *